US009662801B2

(12) United States Patent
Trelstad

(10) Patent No.: US 9,662,801 B2
(45) Date of Patent: May 30, 2017

(54) REPLACEABLE HEAD FOR LOG SPLITTER

(71) Applicant: Matthew Arnold Trelstad, Cokato, MN (US)

(72) Inventor: Matthew Arnold Trelstad, Cokato, MN (US)

( * ) Notice: Subject to any disclaimer, the term of this patent is extended or adjusted under 35 U.S.C. 154(b) by 925 days.

(21) Appl. No.: 13/965,905

(22) Filed: Aug. 13, 2013

(65) Prior Publication Data

US 2014/0048175 A1 Feb. 20, 2014

Related U.S. Application Data

(60) Provisional application No. 61/682,876, filed on Aug. 14, 2012.

(51) Int. Cl.
*B27L 7/00* (2006.01)
*B27L 7/06* (2006.01)

(52) U.S. Cl.
CPC .. *B27L 7/06* (2013.01); *B27L 7/00* (2013.01)

(58) Field of Classification Search
CPC ..... B27L 7/00; B27L 7/005; B27L 7/06
See application file for complete search history.

(56) References Cited

U.S. PATENT DOCUMENTS 4,275,779 A 6/1981 Rowe
4,353,401 A 10/1982 Schilling
4,391,312 A 7/1983 Sakraida, Jr.
4,461,331 A * 7/1984 Mertz ..... B27L 7/00 144/195.1
4,506,712 A 3/1985 Johnson
4,515,194 A 5/1985 Dankel
4,782,870 A 11/1988 Duerr
4,860,806 A 8/1989 Brace
4,961,452 A * 10/1990 Hudson ..... B27L 7/00 144/195.1
5,337,810 A 8/1994 McCormack
5,957,175 A 9/1999 Smith
6,318,424 B1 11/2001 Elfrink
6,408,907 B1 6/2002 Lantz
6,520,226 B1 2/2003 Smith
6,763,864 B2 7/2004 Setlack et al.
6,769,464 B1 8/2004 Jenkin
7,066,223 B2 6/2006 Stone
7,108,029 B2 * 9/2006 Albright ..... B27L 7/06 144/193.2
7,134,464 B2 11/2006 Walker et al.
7,814,945 B2 * 10/2010 Babcock ..... B27L 7/00 144/193.2
7,934,524 B2 5/2011 Priebe
8,091,595 B2 1/2012 Windrich
(Continued)

OTHER PUBLICATIONS

Twin Beam 36" Stroke Skid Steer Log Splitter 30-Ton, http://www.logsplittersales.comiTwin-Beam-36-Stroke-Skid-Steer-Log-Splitter . . . , as printed from website Jul. 13, 2012, 1 pages.
(Continued)

*Primary Examiner* — Matthew G Katcoff
(74) *Attorney, Agent, or Firm* — Schwegman Lundberg & Woessner, P.A.

(57) ABSTRACT

A log splitter system comprises an elongate frame, a socket extending into the elongate frame, and a removable splitter head. The removable splitter head comprises a post positioned within the socket, and a wedge extending from the post.

33 Claims, 8 Drawing Sheets

(56) References Cited

U.S. PATENT DOCUMENTS

| | | | | |
|---|---|---|---|---|
| 2003/0155037 | A1 | 8/2003 | Alexander | |
| 2006/0060262 | A1* | 3/2006 | Hicks | F15B 15/202 144/193.2 |
| 2009/0288737 | A1 | 11/2009 | Gilmet | |
| 2011/0041955 | A1* | 2/2011 | Bedel | B27L 7/00 144/195.1 |
| 2011/0048581 | A1* | 3/2011 | Hicks | B27L 7/06 144/195.8 |
| 2011/0079323 | A1 | 4/2011 | Green | |
| 2012/0132320 | A1 | 5/2012 | Blaha | |

OTHER PUBLICATIONS

Lumberjack Wood Splitter, http://www.lumberjackwoodsplitter.com/, as printed from website on Jul. 13, 2012, 1 page.
Single Bore 530 woodsplitter, http://www.lumberjackwoodsplitter.com/images/TB 530.html, as printed from website, 1 page.
McFarlanes, McFarlane Log Splitters, http://www.mcfarines.net/power-logging-mcfar-splitter.html, as printed from website, 1 page.
Wood Splitters Direct, http://www.woodsplittersdirect.com/shop_by_price.pho?range-4&pa . . . , as printed from website on Jul. 13, 2012, 7 pages.

* cited by examiner

REPLACEABLE HEAD FOR LOG SPLITTER

CROSS-REFERENCE TO RELATED APPLICATION(S)

This application claims priority to U.S. Provisional Patent Application Ser. No. 61/682,876 entitled "REPLACEABLE HEAD FOR LOG SPLITTER," filed Aug. 14, 2012, which is hereby incorporated by reference in its entirety.

BACKGROUND

The present disclosure is directed generally to log or wood splitter systems and more particularly to splitter heads. Log splitters typically comprise a moveable ram that drives a log or other piece of lumber into a head having a wedge. The ram and wedge are typically mounted on top of a frame. The ram is typically driven by a hydraulic power plant. Recent innovations have involved mounting the log splitter system as an implement on a tractor, front-end loader, skid-steer loader, or the like. In such configurations, as is shown in FIG. 1, ram 2 and wedge 3 are mounted underneath frame 4 to enable, for example, skid-steer loader 5 to position the splitter system over piece of wood 6. As such, manual moving and positioning of the wood is eliminated or drastically reduced. In the prior art system, wedge 3 is integrally joined to frame 4, such as via welding. It is desirable, however, to use different types of splitter heads for, e.g., different sized wood, or for splitting a single piece of wood into different number of smaller pieces. Various interchangeable splitter heads have been designed, such as in U.S. Pat. No. 8,091,595 and U.S. Pat. App. Pub. No. 2011/0048581. These designs, however, require the wedge to be hollow, which reduces their intrinsic strength.

SUMMARY

The present invention is directed to a log splitter system comprising an elongate frame, a socket extending into the elongate frame, and a removable splitter head. The removable splitter head comprises a post positioned within the socket, and a wedge extending from the post.

DETAILED DESCRIPTION

Figure 1:
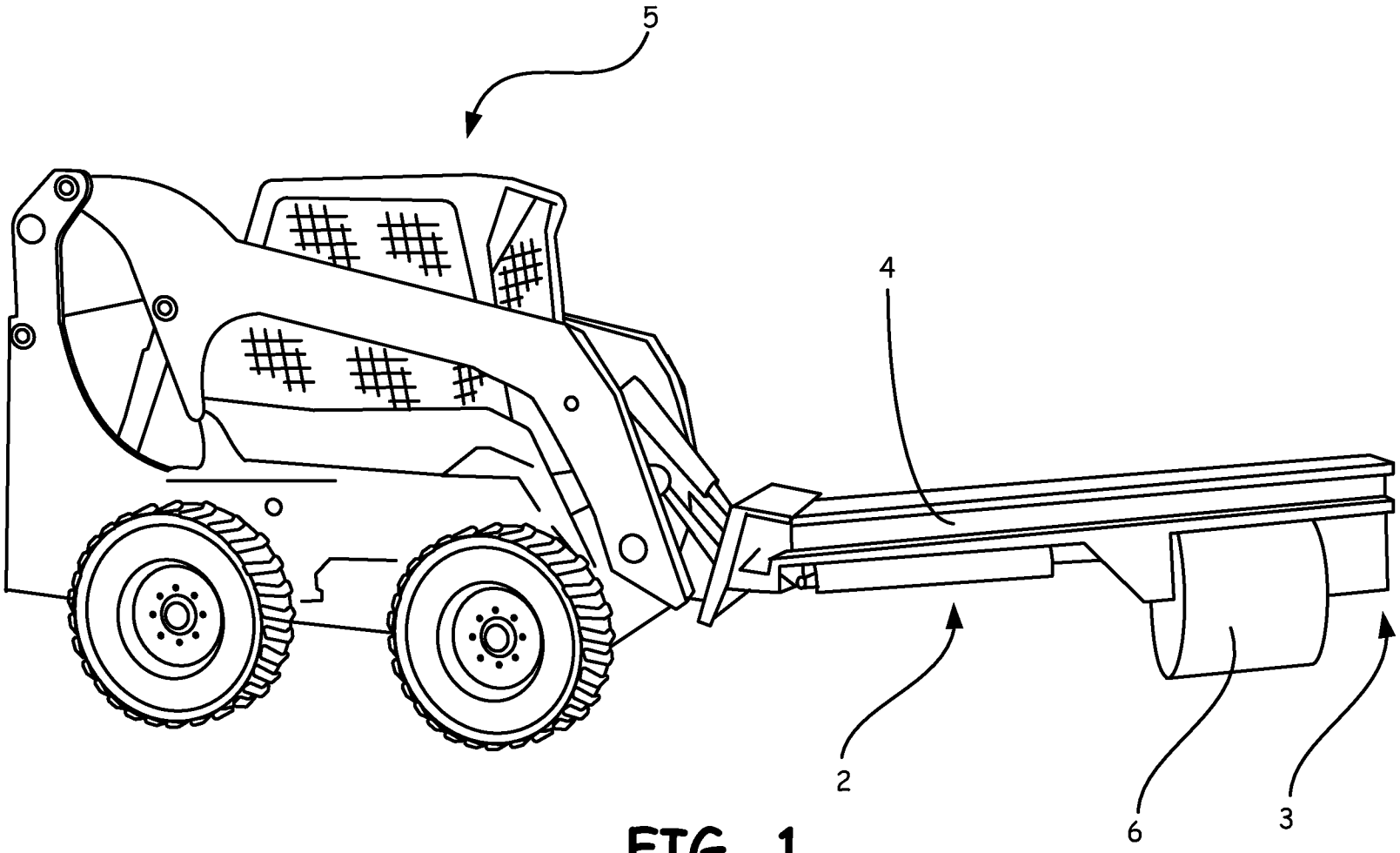
FIG. 1 (PRIOR ART)
FIG. 1 shows a prior art log splitter system mounted as an implement on a skid-steer loader in an under-the-frame configuration.
Figure 2:
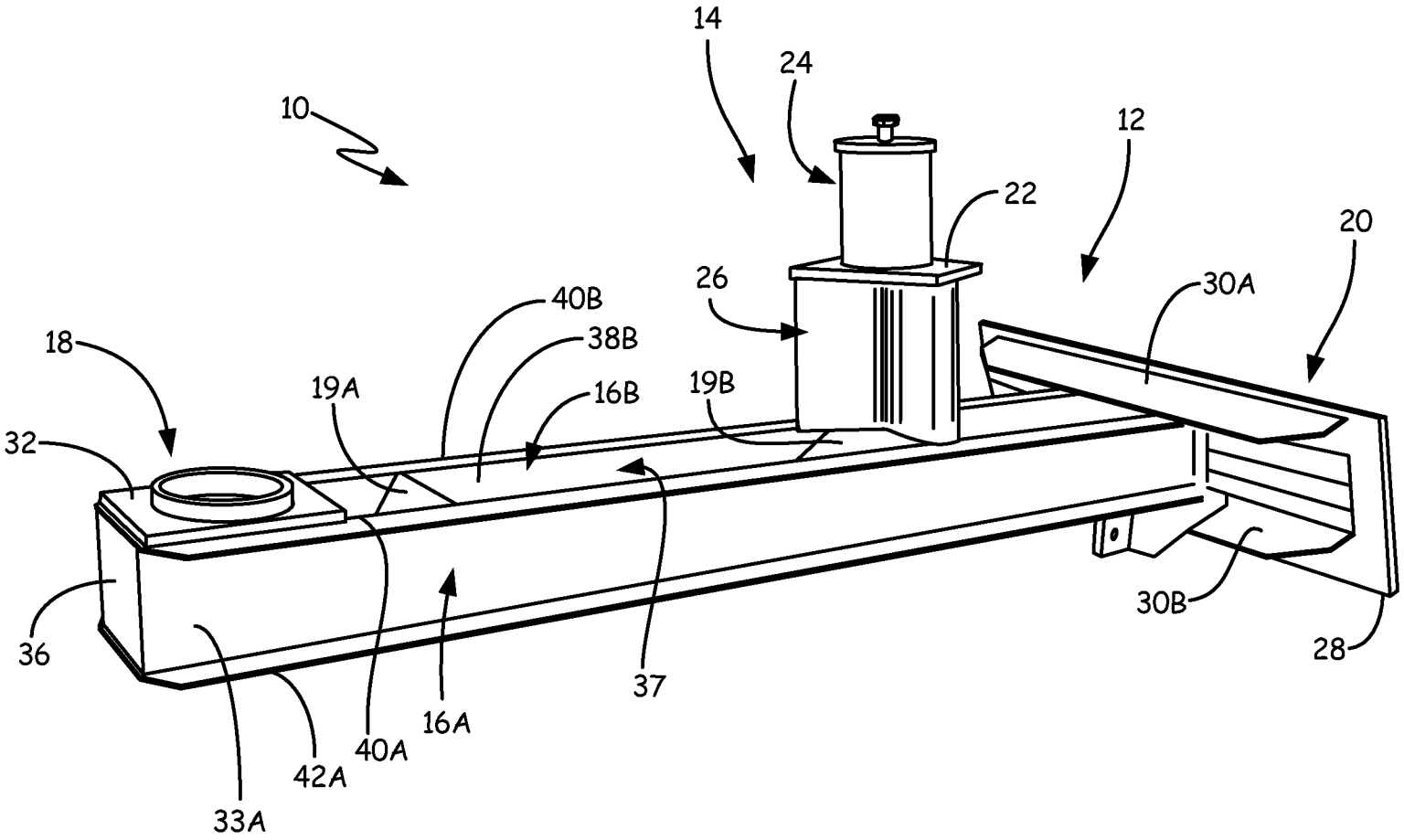
FIG. 2 is a perspective view of a log splitter frame, and a removable splitter head, that is mountable as an implement on a skid-steer loader.

FIG. 2 is a perspective view of log splitter system 10 including frame 12 and removable splitter head 14. Frame 12 is configured for mounting to a loader arm of a skid-steer, such as skid-steer loader 5 of FIG. 1. Frame 12 includes first beam 16A, second beam 16B, socket 18, support 19A, support 19B and mounting platform 20. Removable splitter head 14 includes mounting plate 22, coupling post 24 and splitter wedge 26. Platform 20 includes implement plate 28 and stabilizing plates 30A and 30B. Socket 18 includes cover plate 32, collar 34 and end plate 36.

Mounting platform 20 comprises an assembly for joining log splitter frame 12 to a vehicle, such as a tractor, skid-steer loader or front-end loader. In particular, platform 20 in the depicted embodiment comprises plate 28 for joining to an implement arm of a skid-steer loader, such as a Bobcat®. Frame 20 also includes stabilizing plates 30A and 30B which are joined to plate 26 and beams 16A and 16B. Beams 16A and 16B extend from plate 28 to socket 18. Beams 16A and 16B are spaced apart to provide window 37 in the void or space therebetween. Stabilizing plates 30A and 30B each join to each of beams 16A and 16B and plate 28 to form a structurally rigid body for joining to the vehicle. Other types and configurations of platforms may also be used.

Beams 16A and 16B each comprise a C-beam in the disclosed embodiment. Specifically, beam 16A includes sidewall 38A, top rail 40A and bottom rail 42A, and beam 16B includes sidewall 38B, top rail 40B and bottom rail 42B (not shown). Thus, beams 16A and 16B are also individually stabilized to strengthen the cantilevering from mounting platform 20. Components of log splitter system 10 can be mounted on rails 42A and 42B, such as ram 2 of FIG. 1. In other embodiments, beams 16A and 16B may comprise I-beams or may be simple straight beams. Beams 16A and 16B are also joined mid-length by supports 19A and 19B, which in the embodiment shown comprise plates mounted at an angle between beams 16A and 16B. Supports 19A and 19B also serve to deflect split pieces of wood from being pushed between beams 16A and 16B during splitting operations.

Figure 6:
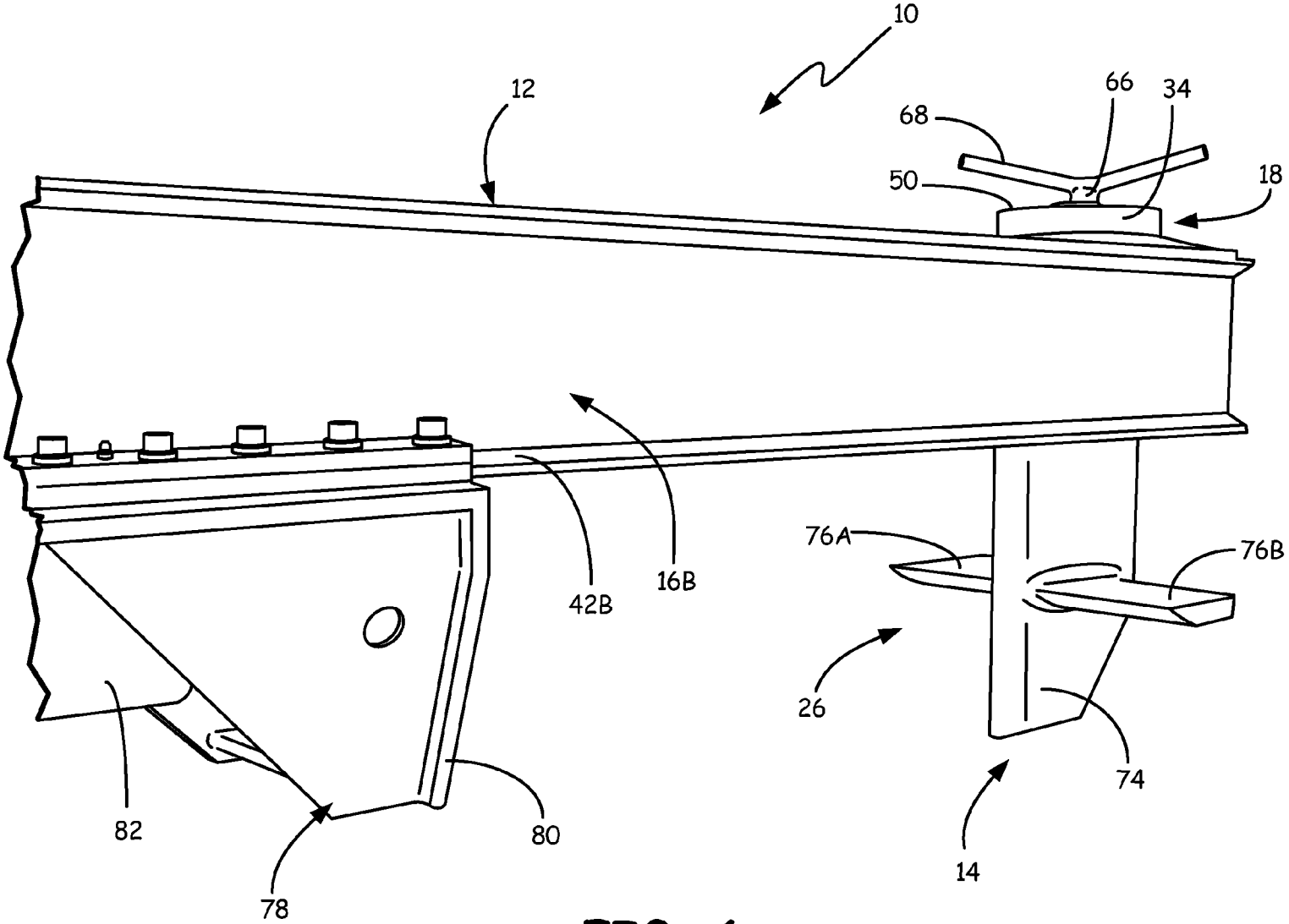
FIG. 6 is a perspective view of the removable splitter head of FIGS. 5A and 5B assembled with the socket of the log splitter frame of FIGS. 2-3B.

Socket 18 joins beams 16A and 16B together at an end of log splitter frame 12 distal from mounting platform 20. Cover plate 32 extends across beams 16A and 16B on an uppers side, and end plate 36 joins cover plate 32 and beams 16A and 16B. Cover plate 32 includes collar 34, which surrounds a bore. A bottom plate (not shown) connects beams 16A and 16B and end plate 36 on a lower side opposite cover plate 32 and includes an aligned bore. Thus, frame 12 is rigidly secured at the end distal to mounting platform 20. Coupling post 24 of removable splitter head 14 is inserted into the bores of the plates from underneath frame 12 so as to be positioned within the space between beams 16A and 16B. Coupling post 24 can be fully seated so that mounting plate 22 is flush with bottom rails 42A and 42B. Although, not shown in FIG. 1, a hydraulic ram, such as ram 2 of FIG. 1 or ram 78 of FIG. 6, is mounted to beams 16A and 16B. The ram includes a ram plate (plate 80 in FIG. 6) against which a piece of wood is positioned. The ram plate is pushed by the hydraulic ram to drive the piece of wood towards splitter wedge 26 when post 24 of removable splitter head 14 is inserted into socket 18.

Figure 3A:
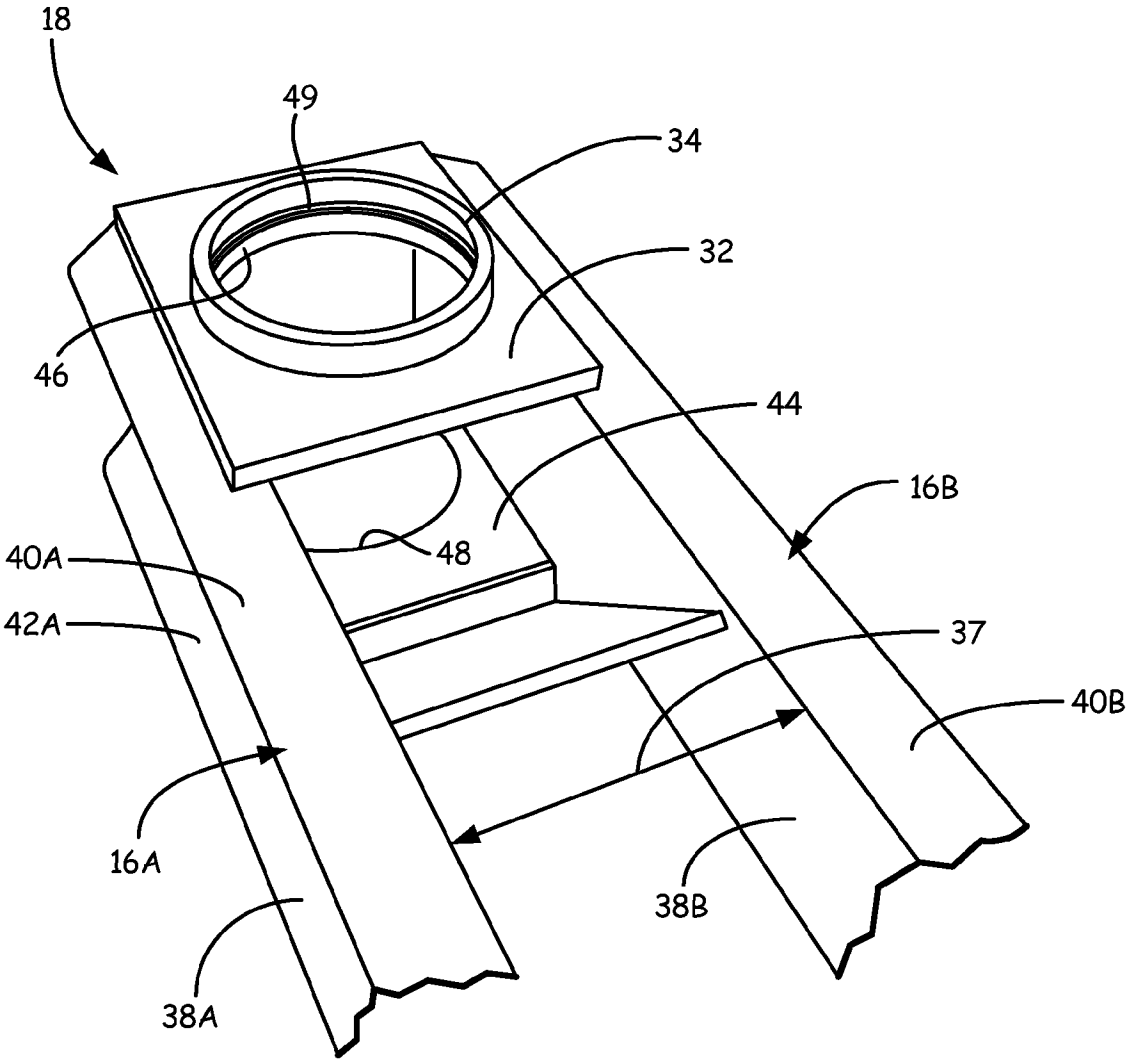
FIG. 3A is a perspective view of a splitter head socket positioned between frame beams and into which the removable splitter head of FIG. 2 can be inserted from underneath.
Figure 3B:
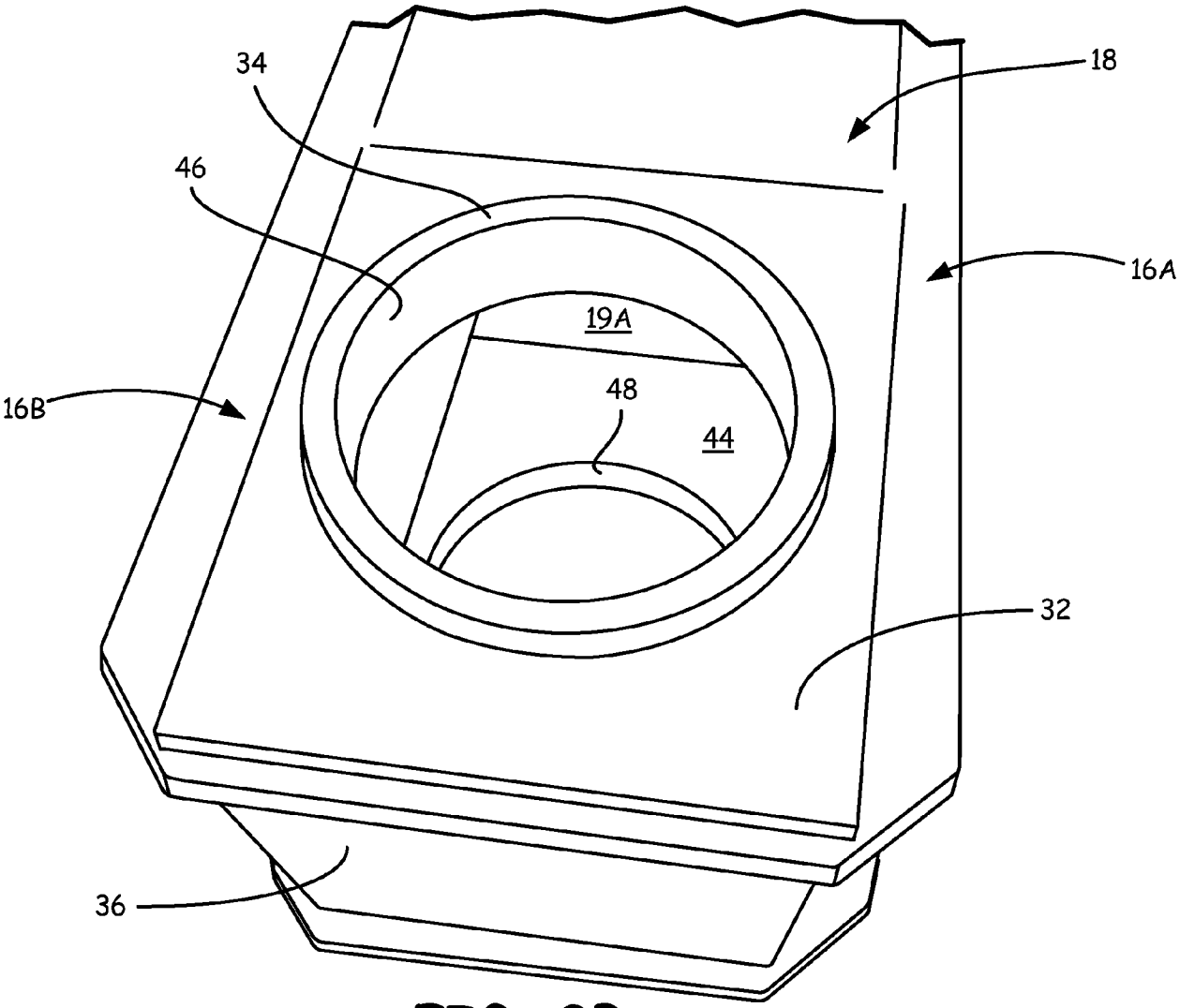
FIG. 3B is a perspective end view of the splitter head socket of FIG. 3A

FIG. 3A is a perspective view of splitter head socket 18 positioned between frame sidewalls 38A and 38B and into which removable splitter head 14 of FIG. 2 can be inserted. FIG. 3B is a perspective end view of splitter head socket 18 of FIG. 3A showing end plate 36. FIGS. 3A and 3B are discussed concurrently. Socket 18 includes cover plate 32, collar 34, end plate 36 and bottom plate 44. Cover plate 32 includes first bore 46, and bottom plate 44 includes second bore 48.

Socket 18 is formed in window 37 between beams 16A and 16B. Cover plate 32 and bottom plate 44 are welded, or otherwise secured, between beams 16A and 16B. Cover plate 32 is positioned on top of the upper surfaces of beams 16A and 16B, while bottom plate 44 is positioned below or spaced from the lower surfaces of beams 16A and 16B to provide a gap for receiving mounting plate 22 (FIG. 2), as will be explained with reference to FIG. 6. End plate 36 is welded or joined to cover plate 32, bottom plate 44 and beams 16A and 16B. Assembled as such, first bore 46 aligns with second bore 48 to form a rigid structure for coupling to post 24 of removable splitter head 14 shown in FIG. 2. Collar 34 is welded or otherwise joined to cover plate 32 to strengthen first bore 46 and provide a ledge for joining removable splitter head 14. As shown in FIG. 3A, collar 34 can be slightly larger than bore 46 to form shelf 49, or collar 34 can be the same diameter as bore 46 as shown in FIG. 3B. Socket 18 is further strengthened by support 19A, which is welded or joined between beams 16A and 16B and links to bottom plate 44. As shown, support 19A angles obliquely across beams 16A and 16B from bottom plate 44 towards the upper (with reference to the orientation of FIG. 2-3B) surfaces of beams 16A and 16B. As such, split wood pieces are guided away from socket 18 during splitting operations if they become forced between beams 16A and 16B.

Figure 4:
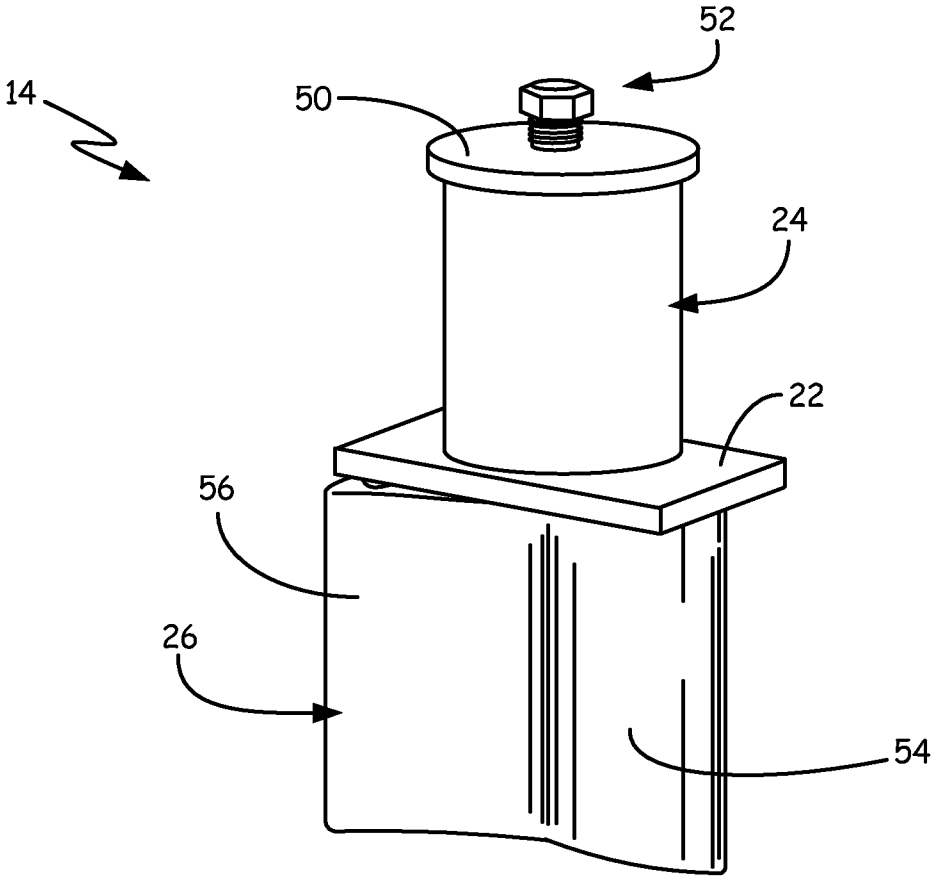
FIG. 4 is a perspective view of the removable splitter head of FIG. 2 showing a mounting plate joining a coupling post and a splitter wedge.

FIG. 4 is a perspective view of removable splitter head 14 of FIG. 2 showing mounting plate 22 joining coupling post 24 and splitter wedge 26. Removable splitter head 14 further comprises cover 50 and fastener 52. Splitter wedge 26 includes blade 54 and strut 56.

Coupling post 24 comprises a body that is insertable into bores 46 and 48 of plates 32 and 44 (FIG. 3B), respectively. Post 24 is welded or otherwise fastened to mounting plate 22 to extend radially opposite splitter wedge 26. In the depicted embodiment, post 24 comprises a cylindrical body that matches the shape of bores 46 and 48. In other embodiments, post 24 and bores 46 and 48 may have other cross-sectional shapes, such as square, hexagonal, octagonal, or the like. Post 24 and bores 46 and 48 need not have the exact same shape. For example, bores 46 and 48 can be round while post 24 is hexagonal. As will be discussed with reference to FIGS. 5A and 5B, post 24 is hollow to facilitate assembly of cover 50 and fastener 52, which enable assembly with socket 18. For example, cover 50 rests flush with post 24 while fastener 52 extends into post 24 to join with a mating component such as a threaded nut.

Blade 54 comprises a solid piece of material, such as steel, that includes a sharpened edge against which pieces of wood are driven to split the pieces into smaller sections. In the depicted embodiment, splitter wedge 26 includes one blade for splitting a piece of wood into two pieces. In other embodiments, splitter wedge 26 may be outfitted with multiple blades for splitting wood into multiple pieces, such as shown in FIG. 6. Blade 54 is a relatively thin, approximately two inches thick, so as to be easily driven into pieces of wood. Blade 54 is approximately twelve inches tall, sufficient to split typical sizes of wood logs, such as large sized tree trunks. Blade 54 can have other dimensions in other embodiments of splitter wedge 26. Blade 54 is deep to provide support strength to react loading from pieces of wood being driven against splitter wedge 26. Specifically, blade 54 is deep to provide a counter moment to the force the wood applied to blade 54. In one embodiment, blade 54 extends completely across mounting plate 22, between struts (of which only strut 56 is shown in FIG. 4). In other embodiments, blade 54 only extends as far as the struts. Strut 56 comprises another solid piece of material, such as steel, that is joined to both mounting plate 22 and blade 54. Strut 56 serves to provide stability to blade 54 by providing support for reacting axial loading from the hydraulic ram, and bending (side-to-side) loading that might be incurred from splitting of the wood pieces. Strut 56 is also angled to deflect split pieces of wood away from blade 54. Blade 54 and strut 56 are joined to mounting plate 22, which provides a platform for joining to post 24. As such, blade 24 can be configured and built without limitation.

Mounting plate 22 provides a flat, open space upon which any type of splitter wedge 26 and post 24 can be built. As such, the structural integrity of each sub-system can be individually tailored and designed. Conversely, prior art interchangeable splitter head systems involved posts that are permanently mounted to the frame and over which different wedges can be placed. Such systems therefore require the wedge to be hollow to receive the post, thereby compromising the mechanical integrity of the wedge. The present invention permits splitter wedge 26 to be, among other things, fabricated from solid components that strengthen splitter head 14. Further, the spaced-apart beam construction of frame 12 of the present invention permits post 24 to be positioned between structural components of splitter system 10 to strengthen the mechanical coupling of splitter head 14 to frame 12. Thus, each blade and wedge form can be made structurally secure and strong without the presence of voids, etc., as has been necessary in the above-referenced prior art.

Figure 5A:
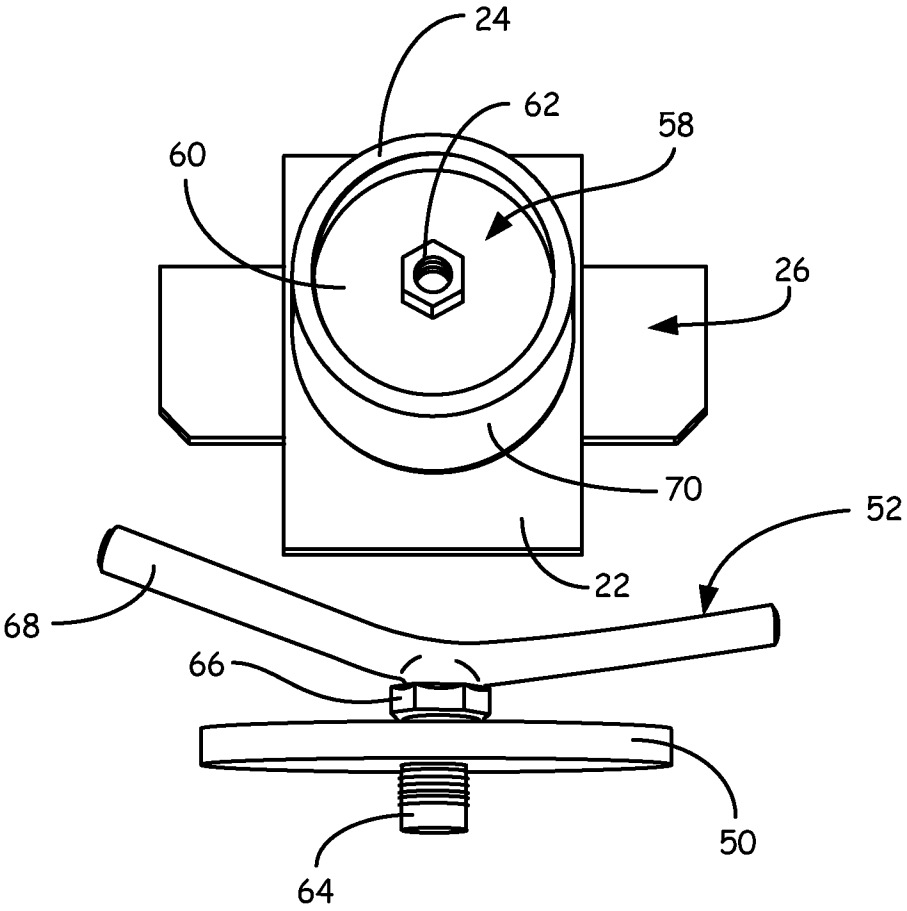
FIG. 5A is an exploded view of a removable splitter head similar to that of FIG. 4 showing a post, a cover, a socket, a cover and a fastener.
Figure 5B:
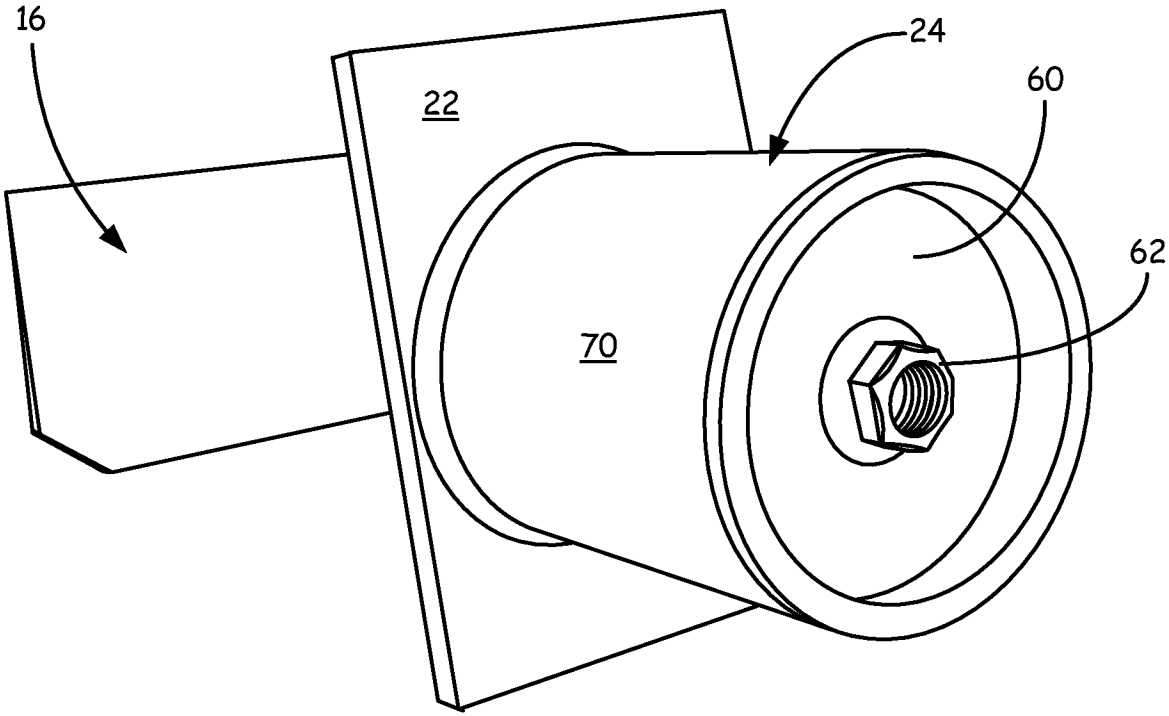
FIG. 5B is a perspective view of the removable splitter head and post of FIG. 5A.

FIG. 5A is an exploded view of removable splitter head 14 similar to that of FIG. 2 showing post 24, cover 50, fastener 52 and socket 58. Socket 58 comprises plate 60 and nut 62. Fastener 52 includes shaft 64, head 66 and handle 68. Post 24 comprises cylinder 70. FIG. 5B is a perspective view of post 24 of FIG. 5A. FIGS. 5A and 5B are discussed concurrently.

Cylinder 70 of post 24 is welded or otherwise joined to mounting plate 22. In the embodiment shown, post 24 is approximately the same width as mounting plate 22 to facilitate insertion between beams 16A and 16B (FIG. 3A). Cylinder 70 is hollow which reduces the weight of splitter head 14 and improves the bending mechanics of post 24. Additionally, plate 60 of socket 58 is inserted into cylinder 70 and joined thereto such as via welding. This allows nut 62 to be recessed within cylinder 70 to permit cover 50 to be flushly joined to the end of cylinder 70 when assembled, as shown in FIG. 6. Nut 62 is welded or otherwise joined to plate 60 to receive shaft 64 of fastener 52. Specifically, shaft 64 is threaded into nut 62 by the application of torque to head 66 such as by manual rotation of handle 68. Shaft 64 can be threaded into nut 62 so far as to permit cover 50 to engage cylinder 70. Cover 50 is larger, or wider, than cylinder 70 so as to overhang the side of post 24. In the described embodiment, cover 50 has a larger diameter than cylinder 70 so at to form a circumferential flange surrounding cylinder 70 when assembled to cylinder 70, as can be seen if FIG. 2. Cover 50 need not have the same shape as cylinder 70. For example, cover 50 can be square or have an X shape. In any embodiment, cover 50 permits removable splitter head 14 to be suspended from socket 18 in frame 12, as discussed with reference to FIG. 6. In one embodiment, cover 50 fits flush against collar 34, as shown in FIG. 6. In another embodiment, cover 50 fits into collar 34 to rest on shelf 49 (FIG. 3A) with collar 34.

FIG. 6 is a perspective view of removable splitter head 14 of FIGS. 5A and 5B assembled with socket 18 of log splitter frame 12 of FIGS. 2-3B. Splitter wedge 26 includes blade 74 and wing blades 76A and 76B. Log splitter system 10 of the present invention also includes ram 78, which includes plate 80 that is driven toward removable splitter head 14 via hydraulic cylinder 82. Splitter wedge 26 varies from that of FIGS. 2 and 4 in that struts 56 are replaced with wing blades 76A and 76B. Thus, splitter wedge 26 of FIG. 6 is used to split one large piece of wood into four smaller pieces.

Frame 12 comprises first beam 16A and second beam 16B (FIG. 2), which are spaced from each other to form a window 37 (FIG. 3A). The window permits cylinder 70 of post 24 to be positioned between the beams. Specifically, cover plate 32 and bottom plate 44 are positioned between beams 16A and 16B and include bores 46 and 48 for receiving cylinder 70. Cylinder 70 is inserted fully into socket 18 such that mounting plate 22 (FIG. 2) is either positioned between beams 16A and 16B (as shown in FIG. 6) or positioned flushly against beams 16A and 16B. In the embodiment of FIG. 6 wherein mounting plate 22 is positioned between beams 16A and 16B, blade 74 is flush with beams 16A and 16B and mounting plate 22 can be used as an anti-rotation and alignment feature for removable splitter head 14. Specifically, with mounting plate 22 having an elongate rectangular shape as shown in FIG. 2, mounting plate 22 will only fit between beams 16A and 16B in two orientations: one with blades 74, 76A and 76B facing towards plate 80, and one with the blades facing away from plate 80. As such, if blade 74 is mounted to mounting plate 22 such that the major axis of each component is aligned, removable splitter head 14 can be aligned such that blade 74 will be pushed straight into oncoming wood. In other words, blade 74 is mounted perpendicular to plate 80. Further, with mounting plate 22 sandwiched between beams 16A and 16B, mounting plate 22 and removable splitter head 14 cannot be rotated when assembled and secured with cover 50 and fastener 52. With cylinder 70 fully seated in socket 18, cover 50 can be assembled to mount flush with collar 34 when head 66 of fastener 52 is fully threaded into nut 62 (FIG. 5B). Thus, splitter wedge 26 is positioned and secured for engaging oncoming wood driven by hydraulic ram 78. As shown, ram 78 is mounted on frame 12 at rails 42A and 42B. Plate 80 is configured to slide along rails 42A and 42B when driven by hydraulic ram 78 to push wood into blades 74 and 76A and 76B. Hydraulic ram 78 comprises a double-acting hydraulic cylinder to proved powered linear movement in both directions so that plate 80 can be repeatedly cycled between being pushed toward splitter wedge 26 and retracted away from splitter wedge 26.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A log splitter system comprises:
a frame extending from a first end to a second end;
a window disposed within the frame;
a socket joined to the frame in the window, the socket comprising:
a first plate extending across a top surface of the frame over the window, the first plate including a first bore for receiving the post of the splitter head; and
a collar surrounding the first bore, the collar including an inner diameter shelf; and
a splitter head having a post, the post configured to extend through the socket and into the window.

2. The log splitter system of claim 1 wherein the frame comprises:
first and second beams extending from the frame to the socket.

3. The log splitter system of claim 2 wherein the first beam is spaced from the second beam to form the window.

4. The log splitter system of claim 3 and further comprising an end plate joining the first beam and the second beam and extending across the window.

5. The log splitter system of claim 3 and further comprising a plurality of reinforcements extending between the first and second beams.

6. The log splitter system of claim 1 wherein the socket further comprises:
a second plate extending across a bottom surface of the frame opposite the first plate, the second plate including a second bore for receiving the post of the splitter head.

7. The log splitter system of claim 1 wherein the splitter head comprises:
a wedge extending from the post.

8. The log splitter system of claim 7 wherein the splitter head further comprises:
a platform positioned between the wedge and the post.

9. The log splitter system of claim 8 wherein:
the post is a hollow body.

10. The log splitter system of claim 9 wherein the splitter head further comprises a removable cover coupled to the post opposite the platform.

11. The log splitter system of claim 10 wherein the splitter head further comprises a fastener extending through the removable cover and into a nut within the hollow body.

12. The log splitter system of claim 10 wherein the removable cover is fitted onto the inner diameter shelf.

13. The log splitter system of claim 8 wherein the splitter head includes struts extending from the wedge and joined to the platform.

14. The log splitter system of claim 8 wherein the platform is positioned within the window between the beams to provide anti-rotation to the splitter head.

15. A removable splitter head for use with a splitter system, the removable splitter head comprising:
a post extending along an axis, the post comprising a hollow cylindrical body;
a wedge extending from a first end of the post along the axis and having a blade protruding from the wedge perpendicular to the axis, the blade having an edge extending parallel to the axis;
a plate disposed in the hollow cylindrical body;
a nut coupled to the plate;
a mounting plate disposed between the wedge and the post; and
a cover plate for positioning against a second end the post opposite the wedge; and
a fastener configured to extend through the cover plate to join with the nut.

16. The removable splitter head of claim 15 wherein the fastener further comprises a handle coupled to the fastener.

17. The removable splitter head of claim 15 wherein the wedge further comprises:

a pair of wing blades extending perpendicularly from the blade.

18. The removable splitter head of claim 15 wherein the wedge further comprises:

a pair of struts extending from the blade.

19. The removable splitter head of claim 15 wherein the blade comprises a solid body welded to the mounting plate.

20. A log splitter system comprises:

a frame extending from a first end to a second end;

a window disposed within the frame;

a socket joined to the frame in the window; and a splitter head comprising:

a post configured to extend through the socket and into the window, the post comprising a hollow body;

a wedge extending from the post;

a platform positioned between the wedge and the post;

a removable cover coupled to the post opposite the platform; and a fastener configured to extend through the removable cover and into a nut within the hollow body.

21. The log splitter system of claim 20 wherein the frame comprises:

first and second beams extending from the frame to the socket.

22. The log splitter system of claim 21 wherein the first beam is spaced from the second beam to form the window.

23. The log splitter system of claim 22 and further comprising an end plate joining the first beam and the second beam and extending across the window.

24. The log splitter system of claim 22 and further comprising a plurality of reinforcements extending between the first and second beams.

25. The log splitter system of claim 20 wherein the socket comprises:

a first plate extending across a top surface of the frame over the window, the first plate including a first bore for receiving the post of the splitter head.

26. The log splitter system of claim 25 wherein the socket further comprises:

a collar surrounding the first bore.

27. The log splitter system of claim 25 wherein the socket further comprises:

a second plate extending across a bottom surface of the frame opposite the first plate, the second plate including a second bore for receiving the post of the splitter head.

28. The log splitter system of claim 20 wherein the platform is positioned within the window between the beams to provide anti-rotation to the splitter head.

29. A log splitter system comprises:

a frame extending from a first end to a second end along a frame axis;

a window disposed within the frame; and a socket joined to the frame at the window, the socket comprising:

a first plate extending across the frame at the window, the first plate including a first bore for receiving the post of the splitter head, the first bore defining a socket axis that is perpendicular to the frame axis; and a splitter head comprising:

a post comprising:

a first end configured to extend into the window and at least partially into the first bore; and a second end configured to be positioned proximate an opposite side of the window as the first end when the first end is inserted into the first bore;

a wedge extending from the second end of the post and configured to be located outside the window, the wedge including a blade edge configured to be parallel to the socket axis when the first end is inserted into the window; and a cover plate configured to be positioned proximate the first end of the post adjacent the frame when the first end is inserted into the window, the cover plate being larger than the first bore to prevent the splitter head from passing through from the socket.

30. The log splitter system of claim 29, wherein the post comprises a hollow cylinder.

31. The log splitter system of claim 30, further comprising:

a fastener configured to extend through the cover plate; and a receptacle disposed in within the hollow cylinder to receive the fastener.

32. The log splitter system of claim 30, further comprising a collar mounted to the first plate to surround the first bore, wherein the collar is located to be positioned between the first plate and the cover plate when the first end of the post is inserted into the window.

33. The log splinter system of claim 29, wherein the splitter head further comprises a platform positioned between the post and the wedge, the platform being larger than the first bore to prevent the splinter head from passing through the socket.

* * * * *